US008948654B2

(12) United States Patent
Ju et al.

(10) Patent No.: US 8,948,654 B2
(45) Date of Patent: Feb. 3, 2015

(54) TRANSFER DEVICE AND IMAGE FORMING APPARATUS HAVING THE SAME

(71) Applicant: Samsung Electronics Co., Ltd., Suwon-si (KR)

(72) Inventors: Jeong Yong Ju, Suwon (KR); Jun Ho Lee, Yongin (KR); Byeong Hwa Ahn, Seongnam (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 72 days.

(21) Appl. No.: 13/681,907

(22) Filed: Nov. 20, 2012

(65) Prior Publication Data

US 2013/0136498 A1 May 30, 2013

(30) Foreign Application Priority Data

Nov. 29, 2011 (KR) ..... 10-2011-0126258

(51) Int. Cl.

| | |
|---|---|
| ***G03G 13/16*** | (2006.01) |
| ***G03G 15/16*** | (2006.01) |
| ***G03G 15/01*** | (2006.01) |

(52) U.S. Cl.

CPC ..... *G03G 15/1615* (2013.01); *G03G 13/16* (2013.01); *G03G 15/0136* (2013.01)

USPC ..... 399/121; 399/313

(58) Field of Classification Search

CPC combination set(s) only.
See application file for complete search history.

(56) References Cited

U.S. PATENT DOCUMENTS

2011/0064487 A1* 3/2011 Ichihashi et al. ..... 399/302

* cited by examiner

*Primary Examiner* — Clayton E Laballe
*Assistant Examiner* — Jas Sanghera
(74) *Attorney, Agent, or Firm* — Staas & Halsey LLP

(57) ABSTRACT

A transfer device and an image forming apparatus having the same are provided. Shapes of cam profiles of first cam members and second cam members controlling movement of first slider members moving a first transfer roller corresponding to a black developer, and second slider members moving a second transfer roller corresponding to a color developer. Times are different as when movement of the first slider members is completed and when movement of the second slider members is completed in mode conversion among a ready mode, a mono mode and a color mode, and thus a driving load generated when the first and second cam members are rotated is reduced, non-uniformity of the rotating speeds of the first and second cam members is reduced, and problems generated due to non-uniform rotating speeds of the cam members are reduced.

13 Claims, 14 Drawing Sheets

TRANSFER DEVICE AND IMAGE FORMING APPARATUS HAVING THE SAME

CROSS-REFERENCE TO RELATED APPLICATIONS

This application is related to and claims priority to Korean Patent Application No. 2011-0126258, filed on Nov. 29, 2011 in the Korean Intellectual Property Office, the disclosure of which is incorporated herein.

BACKGROUND

1. Field

The embodiments discussed herein relate to a transfer device that transfers an image to printing media and an image forming apparatus having the same.

2. Description of the Related Art

An electrophotographic image forming apparatus, which is a kind of image forming apparatus, irradiates light onto photoconductors charged with a designated potential to form electrostatic latent images on the surfaces of the photoconductors, and supplies developers to the electrostatic latent images to form developer images. The developer images formed on the photoconductors may be transferred to a printing medium through a transfer unit, and the developer images transferred to the printing medium pass through a fixing process and discharged to the outside of the image forming apparatus.

In such an image forming apparatus, developing cartridges for corresponding developers for respective colors may be disposed in parallel, and developer images for respective colors overlap with each other by the photoconductors of the respective developing cartridges and respective transfer rollers corresponding thereto to form a color image. Further, in the image forming apparatus, the developing cartridge corresponding to black from among the developing cartridges is operated to form a monochrome image.

If the monochrome image is formed, the photoconductors of the developing cartridges corresponding to colors, except for black, do not need to be operated. Therefore, the photoconductors corresponding to colors, except for black, are not rotated, and the transfer rollers corresponding to these photoconductors are separated from the photoconductors, thereby extending a lifespan of the photoconductors.

Such an image forming apparatus may be changed between three modes, e.g., a ready mode in which a transfer nip between a transfer belt and the photoconductors is not formed, a mono mode in which only a transfer nip of a single color between the transfer belt and one photoconductor is formed through contact, and a color mode in which transfer nips of plural colors between the transfer belt and plural photoconductors are formed through contact. In order to change the image forming apparatus between the three modes, cams and sliders may be used as a mode conversion device for form/release the transfer nips.

In case of such a mode conversion device, two or more cam members may be provided on the same shaft, and as the cams are rotated, the sliders move by the cam members and links connected to the sliders move positions of the transfer rollers of the respective colors, thereby achieving mode conversion among these three modes.

When the cams are rotated, the different cam members having the same phase on the same shaft are simultaneously rotated and simultaneously cause friction with the different sliders, thereby increasing cam driving load.

That is, in order to form/release transfer nips between the photoconductors and the transfer belt, the different cam shapes having the same phase on the same shaft are simultaneously rotated, and thus a friction load between a mono cam shape and a mono slider and friction load between a color cam shape and a color slider may be simultaneously generated and are added to increase cam driving load. A reason for this is that when the color cam and the mono cam move the corresponding sliders, the phases, where the cam shapes reach the top dead centers, are the same.

That is, a time when the mono cam is rotated, contacts the mono slider and maximally pushes the mono slider, and a time when the color cam is rotated, contacts the color slider and maximally pushes the color slider are the same, and thus loads generated when the cams respectively push the corresponding sliders overlap with each other to increase cam driving load.

When the cam driving load is increased, the capacity of a motor driving the cams needs to be increased and the increase in the capacity of the motor raises costs and increases a set size. Further, when the cam driving load is increased, the lifespan of the mode conversion device to form/release transfer nips is lowered, reliability in joint and abrasion is lowered, and thus the lifespan of the transfer device is

SUMMARY

According to an aspect of an exemplary embodiment of the present invention, a transfer device is provided that reduces driving load generated when cams are rotated in order to achieve mode conversion between a ready mode, a mono mode and a color mode determined according to whether a plurality of photoconductors is pressed to a transfer roller, and an image forming apparatus having the transfer device.

According to an aspect of an exemplary embodiment of the present invention a transfer device is provided that improves a method of sensing rotating positions of cams to accurately recognize a converted mode together with reduction of a cam driving load in mode conversion, and an image forming apparatus having the transfer device.

Additional aspects of the invention will be set forth in part in the description which follows and, in part, will be obvious from the description, or may be learned by practice of the invention.

In accordance with an aspect of the present invention, an image forming apparatus includes a plurality of photoconductors, a transfer belt to which images formed on the plurality of photoconductors are transferred, a plurality of transfer rollers corresponding to the plurality of photoconductors, and being movable between transfer positions where the images are transferred to the transfer belt and ready positions separated from the transfer positions, first slider members moving one of the plurality of transfer rollers between the transfer position and the ready position, second slider members moving the remaining transfer rollers between the transfer positions and the ready positions, and a driving unit moving the first slider members and the second slider members, wherein the driving unit includes first cam members moving the first slider members and second cam members moving the second slider members, and when the plurality of transfer rollers moves from the transfer positions to the ready positions, a time when movement of the first slider members is completed and a time when movement of the second slider members is completed are different by means of the first cam members and the second cam members.

The time when movement of the first slider members is completed may be earlier than the time when movement of the second slider members is completed.

The first cam members and the second cam members may be connected to a cam rotating shaft passing through both the first slider members and the second slider members, the first cam member may include a first cam profile pressing a pressed part of the first slider member according to the rotating angle of the first cam member, the second cam member may include a second cam profile pressing a pressed part of the second slider member according to the rotating angle of the second cam member, and the phase of the top dead center of the first cam profile and the phase of the top dead center of the second cam profile may be different so that the time when movement of the first slider members is completed and the time when movement of the second slider members is completed are different.

In order to separate driving load generated due to rotation of the first cam members and driving load generated due to rotation of the second cam members, the first cam profile of the first cam member and the second cam profile of the second cam member may be configured such that a position of the first cam profile, contacting the pressed part of the first slider member to maximally move the first slider member, and a position of the second cam profile, contacting the pressed part of the second slider member to maximally move the second slider member, are different.

The image forming apparatus may further include a motor rotating a cam rotating shaft to which the first cam members and the second cam members are connected, a sensing unit connected to the cam rotating shaft rotating the first cam members and the second cam members, and including an indicating member with a plurality of indicating parts, and a controller recognizing the rotating position of the indicating member based on change of a signal generated when the plurality of indicating parts of the indicating member passes through the sensing unit.

The controller during recognition of the rotating position of the indicating member may recognize the rotating position of the indicating member as one of a first position corresponding to a first mode in which all of the plurality of transfer rollers are located at the ready positions, a second position corresponding to a second mode in which only transfer roller moved by the first slider members is located at the transfer position, and a third position corresponding to a third mode in which all of the plurality of transfer rollers are located at the transfer positions.

The controller during mode conversion may move the indicating member from the first position to the second position, from the second position to the third position, or from the third position to the first position.

The controller during mode conversion may stop the motor after a designated time from change of the signal generated from the sensing unit when the position of the indicating member corresponding to a mode to be converted is close to the sensing unit.

In accordance with an aspect of an exemplary embodiment of the present invention, a transfer device of an image forming apparatus includes a transfer belt to which images formed on a plurality of photoconductors are transferred, a plurality of transfer rollers corresponding to the plurality of photoconductors, and being movable between transfer positions where the images are transferred to the transfer belt and ready positions separated from the transfer positions, first slider members moving one of the plurality of transfer rollers between the transfer position and the ready position, second slider members moving the remaining transfer rollers between the transfer positions and the ready positions, and a driving unit moving the first slider members and the second slider members, wherein the driving unit includes first cam members moving the first slider members and second cam members moving the second slider members, and when the plurality of transfer rollers moves from the transfer positions to the ready positions, a time when movement of the first slider members is completed and a time when movement of the second slider members is completed are different by means of the first cam members and the second cam members.

The time when movement of the first slider members is completed may be earlier than the time when movement of the second slider members is completed.

The first cam members and the second cam members may be connected to a cam rotating shaft passing through both the first slider members and the second slider members, the first cam member may include a first cam profile pressing a pressed part of the first slider member according to the rotating angle of the first cam member, the second cam member may include a second cam profile pressing a pressed part of the second slider member according to the rotating angle of the second cam member, and the phase of the top dead center of the first cam profile and the phase of the top dead center of the second cam profile may be different so that the time when movement of the first slider members is completed and the time when movement of the second slider members is completed are different.

In order to separate driving load generated due to rotation of the first cam members and driving load generated due to rotation of the second cam members, the first cam profile of the first cam member and the second cam profile of the second cam member may be configured such that a position of the first cam profile contacting the pressed part of the first slider member to maximally move the first slider member and a position of the second cam profile contacting the pressed part of the second slider member to maximally move the second slider member are different.

BRIEF DESCRIPTION OF THE DRAWINGS

These and/or other aspects of the invention will become more apparent from the following description of certain exemplary embodiments with reference to the accompanying drawings in which.

DETAILED DESCRIPTION

Figure 1:
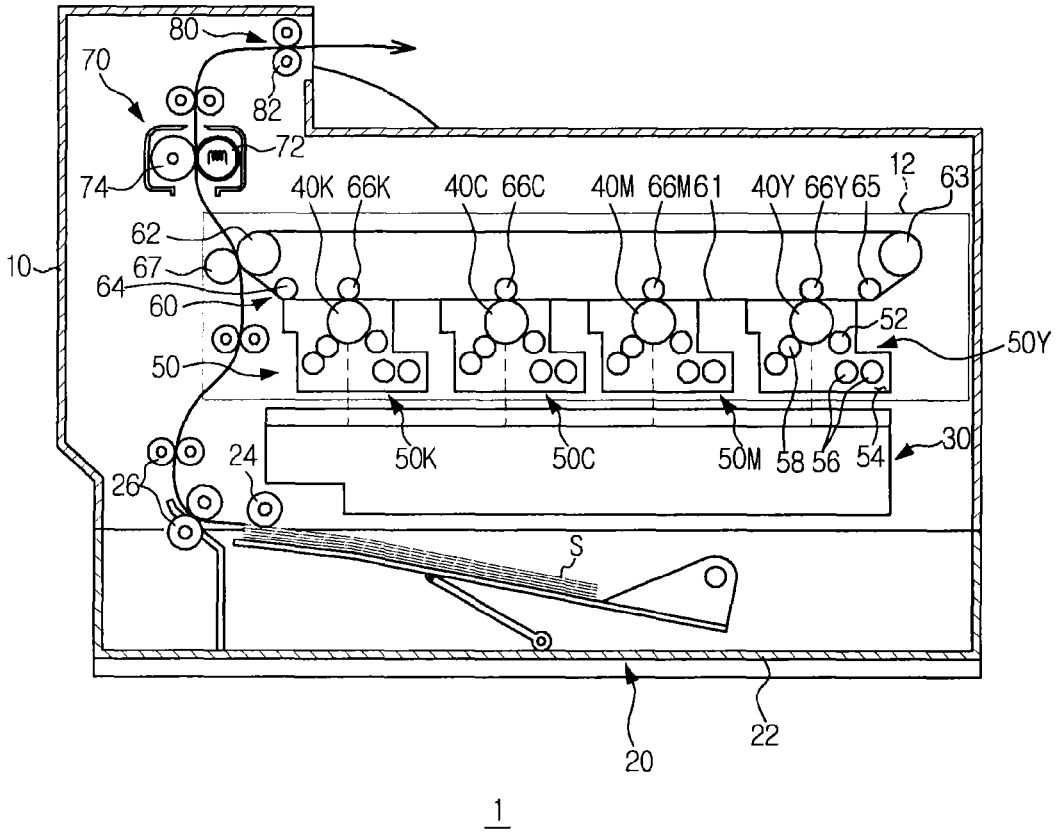
FIG. 1 illustrates an image forming apparatus in accordance with an exemplary embodiment of the present invention.

Reference will now be made in detail to exemplary embodiments of the present invention, examples of which are illustrated in the accompanying drawings, wherein like reference numerals refer to like elements throughout.

FIG. 1 illustrates an image forming apparatus in accordance with an exemplary embodiment of the present invention.

As illustrated in FIG. 1, the image forming apparatus 1 includes photoconductors 40Y, 40M, 40C and 40K corresponding to developers of respective colors so as to selectively form color and monochrome images. The photoconductors 40Y, 40M, 40C and 40K may be positioned in an intermediate manner so visible images on the photoconductors 40Y, 40M, 40C and 40K are not directly transferred to printing media S.

The image forming apparatus 1 includes a main body 10, a printing medium supply device 20, an optical scanning device 30, the plural photoconductors 40Y, 40M, 40C and 40K, a developing device 50, a transfer device 60, a fixing device 70 and a printing medium exit device 80.

The main body 10 forms the external appearance of the image forming apparatus 1 and may support various elements installed therein. A main body cover 12 may be rotatably installed on the front surface of the main body 10. The main body cover 12 opens and closes a part of the main body 10. A user may open the part of the main body 10 through the main body cover 12, to access and/or attach and/or detach various elements to, and from, the inside of the main body 10.

The printing medium supply device 20 includes a cassette 22 in which printing media S are stored, a pickup roller 24 picking the printing media S stored in the cassette 22 up, for example, sheet by sheet, and transfer rollers 26 transferring the picked-up printing media S to the transfer device 60.

The optical scanning device 30 irradiates light corresponding to image information to the photoconductors 40Y, 40M, 40C and 40K and thus forms electrostatic latent images on the surfaces of the photoconductors 40Y, 40M, 40C and 40K. To differentiate the photoconductors 40Y, 40M, 40C and 40K from each other, the photoconductor 40C may be referred to as a first photoconductor, the photoconductor 40M will be referred to as a second photoconductor, the photoconductor 40Y will be referred to as a third photoconductor, and the photoconductor 40K will be referred to as a fourth photoconductor.

The developing device 50 supplies developers to the electrostatic latent images formed on the photoconductors 40Y, 40M, 40C and 40K, thus forming visible images. The developing device 50 may include four developing cartridges 50Y, 50M 50C and 50K respectively accommodating developers of different colors, for example, developers of black (K), cyan (C), magenta (M) and yellow (Y).

Each of the developing cartridges 50Y, 50M 50C and 50K includes a charger 52, a developer storage part 54, developer transfer members 56 and a developing member 58. The respective chargers 52 uniformly charge the surfaces of the photoconductors 40Y, 40M, 40C and 40K prior to formation of the electrostatic latent images on the photoconductors 40Y, 40M, 40C and 40K. The developers stored in the developer storage parts 54 may be transferred to the developing members 58 by the developer transfer members 56, and the developing members 58 supplies the developers to the electrostatic latent images formed on the photoconductors 40Y, 40M, 40C and 40K to form visible images.

The transfer device 60 receives the visible images formed on the photoconductors 40Y, 40M, 40C and 40K in an intermediate transfer manner, and transfers the visible images to the printing media. The transfer device 60 includes a transfer belt 61 rotated in a caterpillar type and contacting the photoconductors 40Y, 40M, 40C and 40K to allow the visible images to be transferred to the transfer belt 61 so as to overlap each other, a driving roller 62 rotating the transfer belt 61, a support roller 63, tension rollers 64 and 65 providing tension to the transfer belt 61, transfer rollers 66Y, 66M, 66C and 66K, and a backup roller 67.

The transfer belt 61 may be rotated while being supported by the driving roller 62 and the support roller 63, and the outer circumferential surface of the transfer belt 61 is opposite the respective photoconductors 40Y, 40M, 40C and 40K. The transfer rollers 66Y, 66M, 66C and 66K are disposed to correspond to the photoconductors 40Y, 40M, 40C and 40K, and support the inner circumferential surface of the transfer belt 61.

The transfer rollers 66Y, 66M, 66C and 66K may be divided into a first transfer roller 66K and second transfer rollers 66Y, 66M and 66C corresponding to the photoconductors 40Y, 40M, 40C and 40K across the transfer belt 61. The first transfer roller 66K and the second transfer rollers 66Y, 66M and 66C may be opposite the photoconductors 40Y, 40M, 40C and 40K and transfer the visible images on the photoconductors 40Y, 40M, 40C and 40K to the transfer belt 61.

A first transfer roller 66K corresponds to a black developer. Further, three second transfer rollers 66Y, 66M and 66C respectively correspond to color developers except for the black developer, i.e., yellow, magenta and cyan developers.

A printing medium S having passed through the transfer device 60 may enter the fixing device 70. The fixing device 70 includes a heating roller 72 and a pressing roller 74. The printing medium S to which the images have been transferred passes through a gap between the heating roller 72 and the pressing roller 74, and the images are fixed to the printing medium S by heat and pressure.

The printing medium S having passed through the fixing device 70 may be guided to the printing medium exit device 80, and discharged to the outside of the main body 10 by exit rollers 82.

When the image forming device 1 performs a color printing operation, the first transfer roller 66K and the second transfer rollers 66Y, 66M and 66C are pressed to the respective photoconductors 40Y, 40M, 40C and 40K. The visible images formed on the photoconductors 40Y, 40M, 40C and 40K are transferred to the transfer belt 61 by the first transfer roller 66K and the second transfer rollers 66Y, 66M and 66C and overlap with each other, and the images on the transfer belt 61 are transferred to the printing medium S supplied from the printing medium supply device 20 and passing through a gap between the backup roller 67 and the transfer belt 61.

When the image forming device 1 performs a monochrome printing operation, only the first transfer roller 66K is pressed to the photoconductor 40K, and the second transfer rollers 66Y, 66M and 66C are separated from the photoconductors 40Y, 40M and 40C.

That is, in the color mode in which the color printing operation is performed, all of the first transfer roller 66K and the second transfer rollers 66Y, 66M and 66C are pressed to the photoconductors 40Y, 40M, 40C and 40K. In the mono mode in which the monochrome printing operation is performed, only the first transfer roller 66K is pressed to the photoconductor 40K, and the second transfer rollers 66Y, 66M and 66C are separated from the photoconductors 40Y, 40M and 40C. In the ready mode in which both the color printing operation and the monochrome printing operation are not performed, but the image forming apparatus 1 is in a standby state, all of the first transfer roller 66K and the second transfer rollers 66Y, 66M and 66C are separated from the photoconductors 40Y, 40M, 40C and 40K.

Figure 2:
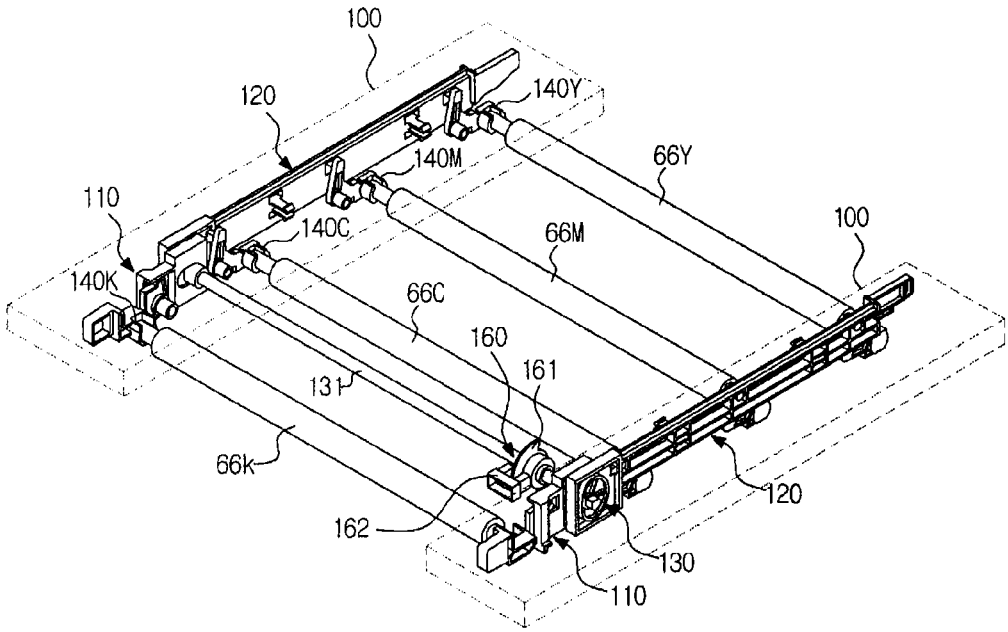
FIG. 2 illustrates a transfer device of the image forming apparatus in accordance with an exemplary embodiment of the present invention.

FIG. 2 illustrates an exemplary transfer device of the image forming apparatus in accordance with an exemplary embodiment of the present invention.

As illustrated in FIG. 2, the transfer device 60 includes support frames 100, the first transfer roller 66K, the second transfer rollers 66Y, 66M and 66C, first slider members 110, second slider members 120 and a driving unit 130. The transfer device 60 further includes first lever members 140K and second lever members 140Y, 140M and 140C.

The support frames 100 support various elements of the transfer device 60, for example, the first transfer rollers 66K and the second transfer rollers 66Y, 66M and 66C. The support frames 100 support the first slider members 110, the second slider members 120 and the driving unit 130.

The first transfer roller 66K and the second transfer rollers 66Y, 66M and 66C may be installed on the support frames 100 corresponding to the respective photoconductors 40Y, 40M, 40C and 40K, and are arranged in a first direction. The first transfer roller 66K may be disposed to be opposite the inner surfaces of the first slider members 110, and the second transfer rollers 66Y, 66M and 66C are disposed to be opposite the inner surfaces of the second slider members 120 in the first direction. Movement of the first transfer roller 66K and the second transfer rollers 66Y, 66M and 66C is guided so that the first transfer roller 66K and the second transfer rollers 66Y, 66M and 66C become close to, or separated, from the photoconductors 40Y, 40M, 40C and 40K or the inner surface of the transfer belt 61.

The first lever members 140K are disposed between the first slider members 110 and the first transfer roller 66K, and change first directional movement of the first slider members 110 to second directional movement of the first transfer roller 66K.

The second lever members 140Y, 140M and 140C are disposed between the second slider members 120 and the second transfer rollers 66Y, 66M and 66C, and change first directional movement of the second slider members 120 to second directional movement of the second transfer rollers 66Y, 66M and 66C.

Figure 3:
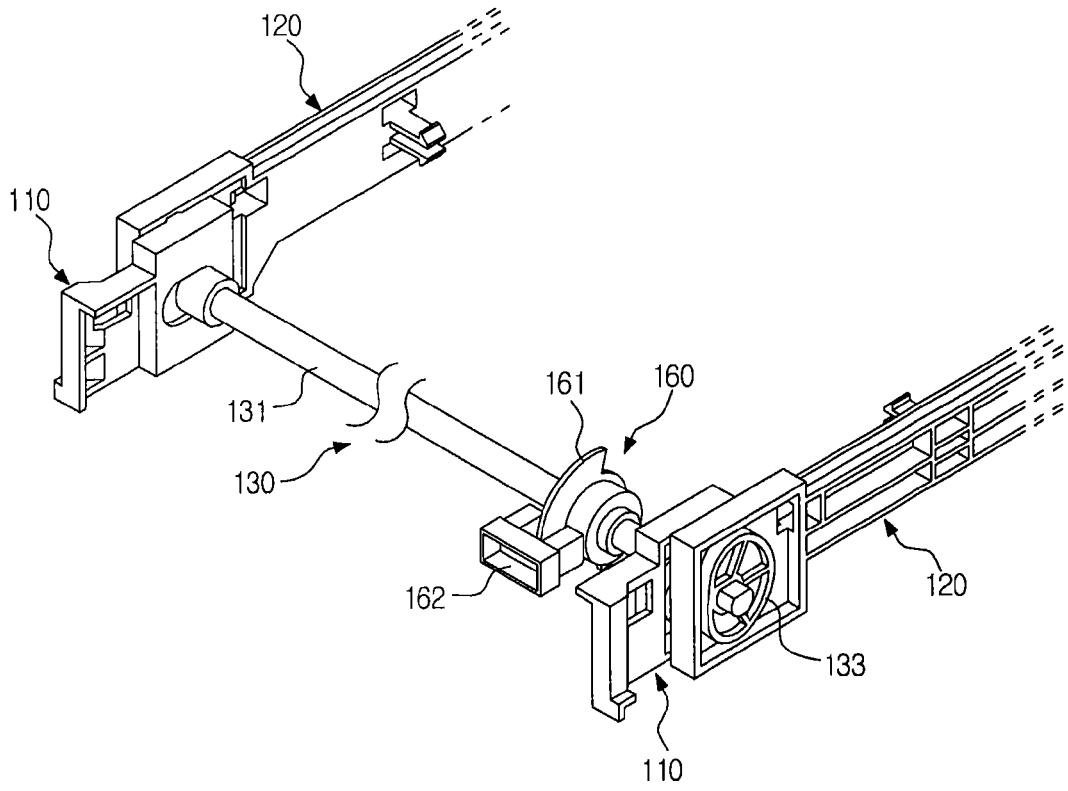
FIG. 3 illustrates exemplary first slider members and second slider members of the transfer device of the image forming apparatus in accordance with an embodiment of the present invention.
Figure 4:
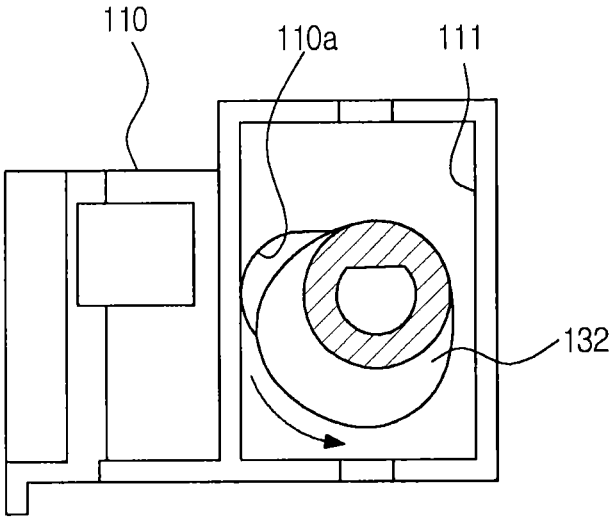
FIG. 4 illustrates an exemplary pressed part of the first slider member of the transfer device of the image forming apparatus in accordance with an exemplary embodiment of the present invention.
Figure 5:
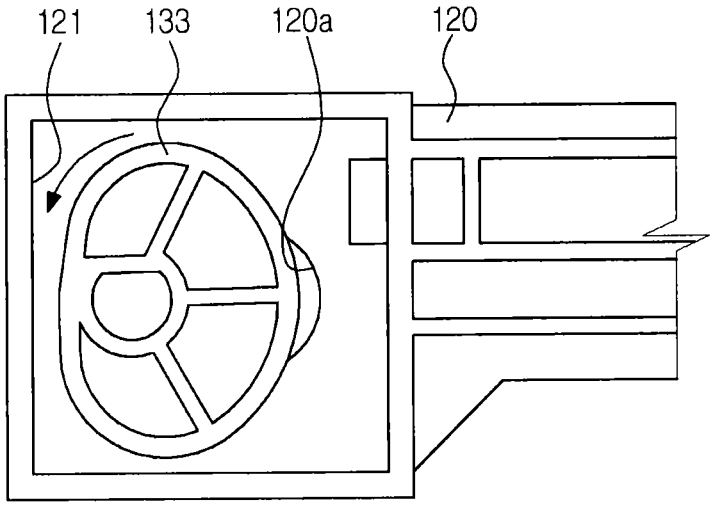
FIG. 5 illustrates a pressed part of the second slider member of the transfer device of the image forming apparatus in accordance with an embodiment of the present invention.

FIG. 3 illustrates the first slider members and the second slider members of the transfer device of the image forming apparatus in accordance with an embodiment of the present invention, FIG. 4 illustrates a pressed part of the first slider member of the transfer device of the image forming apparatus in accordance with an embodiment of the present invention, and FIG. 5 illustrates a pressed part of the second slider member of the transfer device of the image forming apparatus in accordance with an embodiment of the present invention.

As illustrated in FIGS. 3 to 5, the first slider members 110 and the second slider members 120 may be movably connected to the support frames 100.

The first slider members 110 may be extendable in the Y direction perpendicular to the extending direction of the first transfer roller 66K, i.e., the X direction. The first slider members 110 move in the +Y direction and −Y direction with respect to the support frames 100.

A through hole 110*a* may be formed at one end of the first slider member 110 so that a first cam member 132 may pass through the through hole 110*a*, and a first pressed part 111 may be formed adjacent to the through hole 110*a*.

The first pressed part 111 is a region of the first slider member 110 that is pressed by the cam profile of the first cam member 132.

The first pressed part 111 may be disposed in the +Y direction and −Y direction of the first cam member 132, thereby allowing the first slider member 110 to move in the +Y direction or −Y direction according to rotation of the first cam member 132.

The second slider members 120 may be extendable in the Y direction perpendicular to the extending direction of the second transfer rollers 66Y, 66M and 66C, i.e., the X direction. The second slider members 120 move in the +Y direction and −Y direction with respect to the support frames 100.

A through hole 120*a* may be formed at one end of the second slider member 120 so that a second cam member 133 which will be described later may pass through the through hole 120*a*, and a second pressed part 112 may be formed adjacent to the through hole 120*a*.

The second pressed part 112 is a region of the second slider member 120 which is pressed by the cam profile of the second cam member 133.

The second pressed part 112 may be disposed in the +Y direction and −Y direction of the second cam member 133, thereby allowing the second slider member 120 to move in the +Y direction or −Y direction according to rotation of the second cam member 133.

The driving unit 130 drives the first slider members 110 and the second slider members 120. The driving unit 120 simultaneously moves both the two slider members 110 and 120, or selectively moves one of the two slider members 110 and 120.

The driving unit 130 includes a cam rotating shaft 131 rotatably installed on the support frames 100 and passing through both the first slider members 110 and the second slider members 120, the first cam members 132 connected to the cam rotating shaft 131 to move the first slider members 110, and the second cam members 133 connected to the cam rotating shaft 131 to move the second slider members 120.

Figure 7:
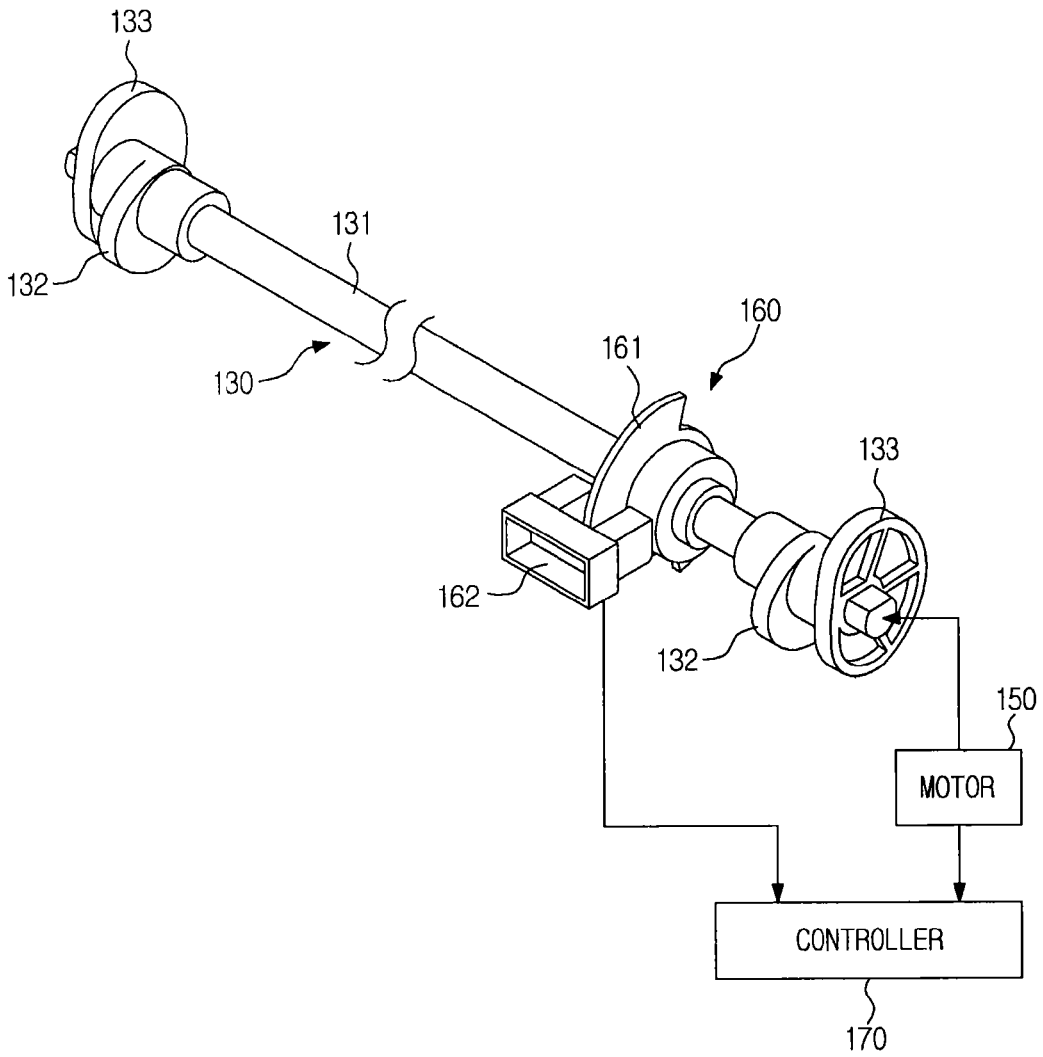
FIG. 7 illustrates an exemplary driving unit of the transfer device, and a sensing unit, a motor and a controller necessary to operate the driving unit in the image forming apparatus in accordance with an embodiment of the present invention.

The cam rotating shaft 131, the first cam members 132 and the second cam members 133 may be rotated by a driving force received from a motor 150 (as illustrated, for example, in FIG. 7). The first slider members 110 and the second slider members 120 move to right or left to a designated length by rotation of the first cam members 132 and the second cam members 133, and the first lever members 140K and the second lever members 140Y, 140M and 140C are rotated on hinge points thereof by horizontal movement of the first slider members 110 and the second slider members 120. When the first lever members 140K and the second lever members 140Y, 140M and 140C are rotated, the first transfer roller 66K and the second transfer rollers 66Y, 66M and 66C fixed thereto are also rotated and contact, or are separated from, the corresponding photoconductors 40Y, 40M, 40C and 40K, thereby forming, or releasing, transfer nips.

Although an exemplary embodiment includes the first cam member 132 and the second cam member 133 as members that are formed integrally on the same shaft, the first cam member 132 and the second cam member 133 may have independent cam rotating shafts.

The first cam member 132 and the second cam member 133 have cam profiles respectively pressing the pressed part 111 of the first slider member 110 and the pressed part 112 of the second slider member 120 according to rotating angles of the first cam member 132 and the second cam member 132.

Figure 6:
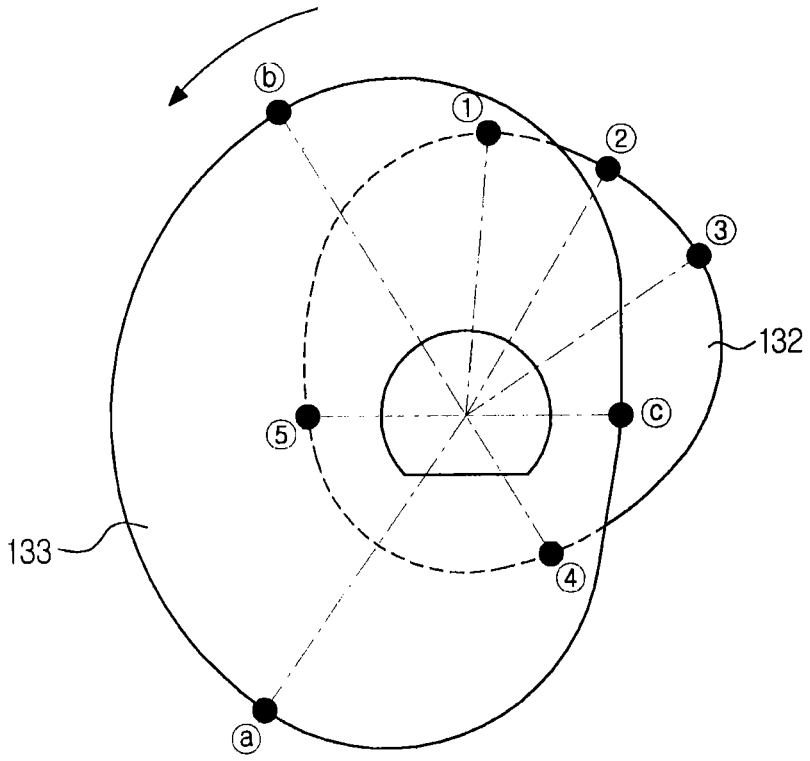
FIG. 6 illustrates exemplary cam profiles of a first cam member and a second cam member of a driving unit of the transfer device of the image forming apparatus in accordance with an embodiment of the present invention.

FIG. 6 illustrates exemplary cam profiles of the first cam member and the second cam member of the driving unit of the transfer device of the image forming apparatus in accordance with an embodiment of the present invention.

As illustrated in FIG. 6, in the cam profile of the first cam member 132, a section from the point ① to the point ③ is a top dead center area where the first cam member 132 contacts the pressed part 111 of the first slider member 110 in the ready mode.

The point ④ is a point corresponding to the pressed part 111 of the first slider member 110 in the mono mode.

The point ⑤ is a point corresponding to the pressed part 111 of the first slider member 110 in the color mode.

In the cam profile of the second cam member 133, the point ⓐ is the top dead center where the second cam member 133 contacts the pressed part 121 of the second slider member 120 in the ready mode.

The point ⓑ is the top dead point where the second cam member 133 contacts the pressed part 121 of the second slider member 120 in the mono mode.

The point ⓒ is a point corresponding to the pressed part 121 of the second slider member 120 in the color mode.

When the cam rotating shaft 131 is rotated, the first cam members 132 and the second cam members 133 fixed to the cam rotating shaft 131 may be rotated to perform movement of the first slider members 110 and the second slider members 120.

In a conventional transfer device, the top dead centers of the cam profiles of first and second cam members, i.e., positions of the respective cam members contacting respective slider members to maximally move the slider members are the same. Therefore, when the respective cam members are rotated, the cam members simultaneously move the two slider members and thus driving loads thereof overlap with each other.

However, in case of the transfer device 60 in accordance with an embodiment of the present invention, phases of the top dead centers of the cam profiles of the first cam member 132 and the second cam member 133 are different. For example, the first cam member 132 reaches the top dead center thereof earlier than the second cam member 133 reaches the top dead center thereof by an angle, for example, of 22 degrees and is separated from the top dead center thereof later than the second cam 133 is separated from the top dead center thereof, for example, by an angle of 22 degrees. Thereby, driving loads generated due to rotation of the cam members 132 and 133 are divided, and thus a total cam driving load may be reduced.

A time when the first transfer roller 66K is separated from the first photoconductor 40K may be earlier than a time when the second transfer rollers 66Y, 66M and 66C are separated from the second photoconductors 40Y, 40M and 40C, for example, by an angle of 22 degrees.

The shapes of the cam profiles of the first cam member 132 and the second cam member 133 are not limited, but may be variously modified within the scope and spirit of an exemplary embodiment of the present invention.

Increased recognition accuracy of mode conversion from the ready mode to the mono mode, from the mono mode to the color mode, from the color mode to the ready mode is disclosed.

FIG. 7 illustrates a driving unit of the transfer device, and a sensing unit, a motor and a controller necessary to operate the driving unit in the image forming apparatus in accordance with an embodiment of the present invention.

As illustrated in FIG. 7, the image forming apparatus 1 includes a motor 150 rotating the cam rotating shaft 131, a sensing unit 160 provided on the cam rotating shaft 131, and a controller 170.

The sensing unit 160 includes an indicating member 161 and a sensor 162. The sensor 162 senses indicating parts 161*a* and 161*b* formed on the indicating member 161 and thus senses the rotating position of the indicating member 161.

The controller 170 controlling the overall operation of the image forming apparatus 1 recognizes the rotating position of the indicating member 161 sensed by the sensor 162, judges which mode is the current mode of the image forming apparatus 1 among the ready mode, the mono mode and the color mode based on the recognized rotating position, and, in order to change the current mode of the mage forming apparatus 1 to another mode to be controlled, adjusts the operating time of the motor 150 to move the cam profiles of the first cam members 132 and the second cam members 133 to proper positions.

That is, the controller 170 presses all of the first transfer roller 66K and the second transfer rollers 66Y, 66M and 66C to the photoconductors 40Y, 40M, 40C and 40K, in the color mode in which the color printing operation is performed.

The controller 170 presses only the first transfer roller 66K to the photoconductor 40K and separates the second transfer rollers 66Y, 66M and 66C from the photoconductors 40Y, 40M and 40C, in the mono mode in which the monochrome printing operation is performed.

The controller 170 separates all of the first transfer roller 66K and the second transfer rollers 66Y, 66M and 66C from the photoconductors 40Y, 40M, 40C and 40K, in the ready mode in which both the color printing operation and the monochrome printing operation are not performed.

Figure 8:
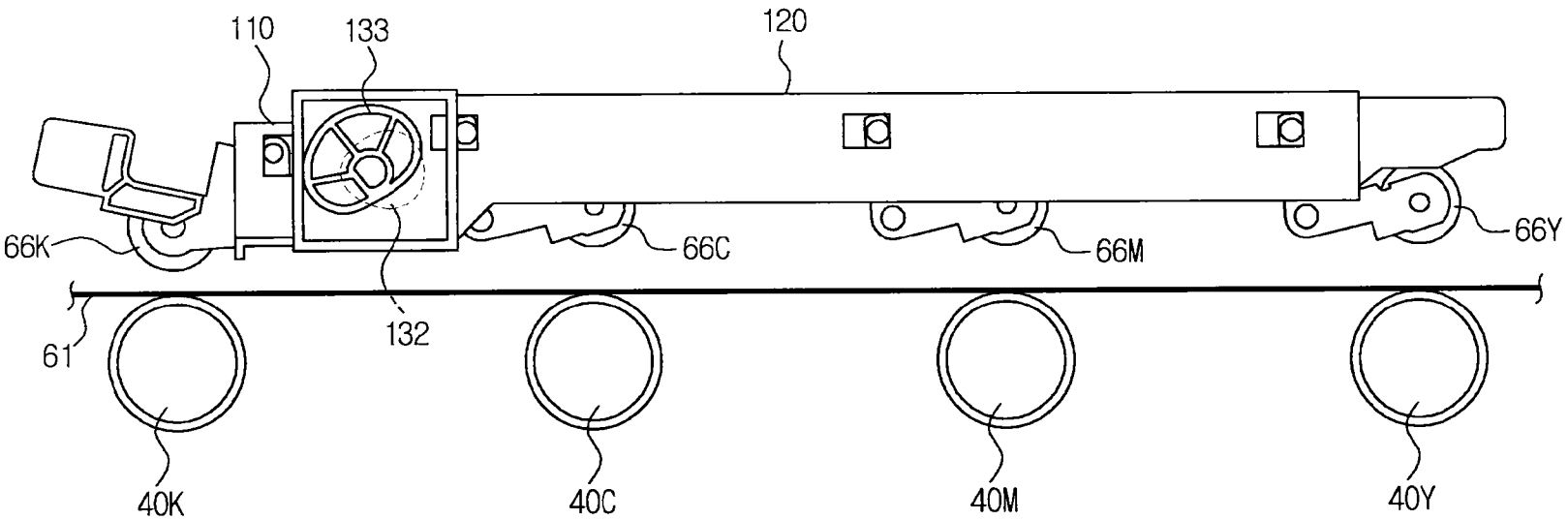
FIGS. 8 to 10 illustrates exemplary operation of the transfer device of the image forming apparatus in accordance with the embodiment of the present invention.
Figure 9:
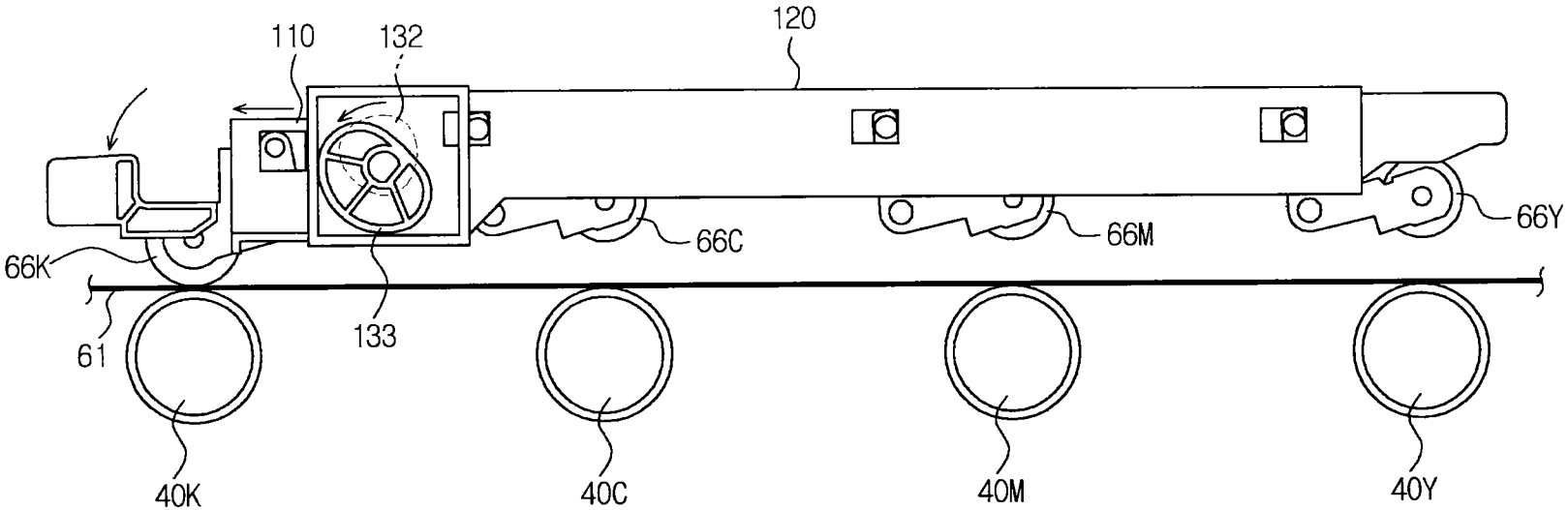
Figure 10:
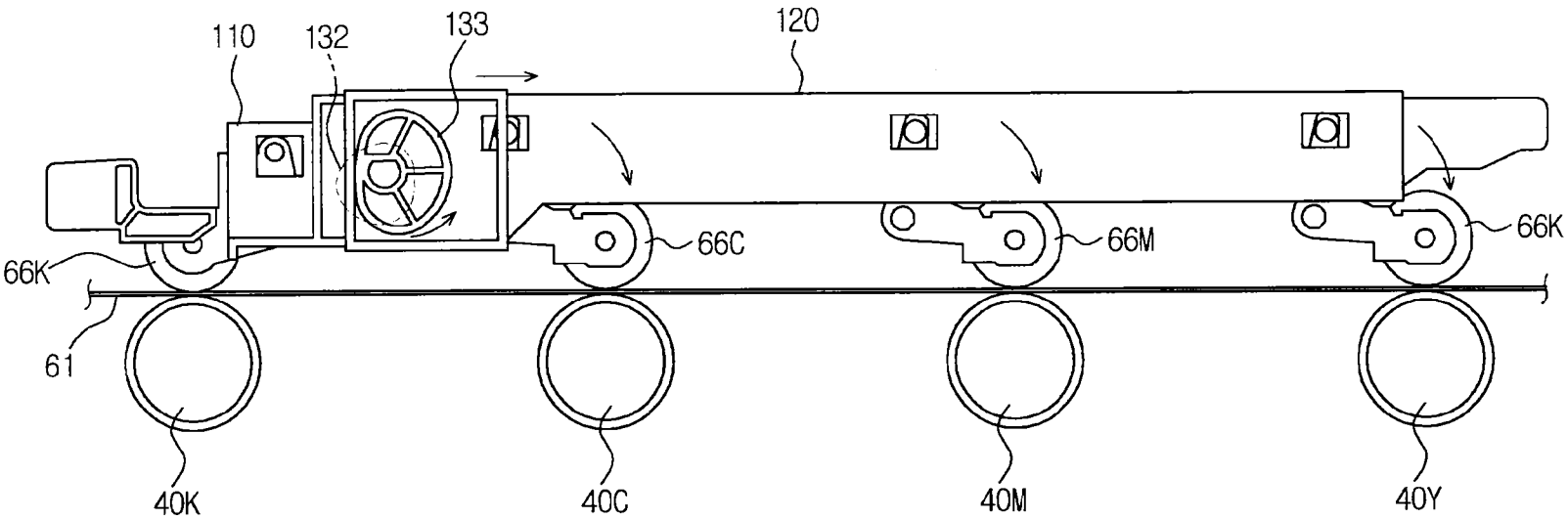

FIGS. 8 to 10 illustrate a transfer device of the image forming apparatus in accordance an embodiment of the present invention.

FIGS. 8 to 10 represent states of the first slider member 110 and the second slider member 120 in the ready mode, the mono mode and the color mode.

A position where transfer may be performed by pressing the first transfer roller 66K or the second transfer roller 66Y, 66M or 66C to the photoconductor 40Y, 40M, 40C or 40K and the transfer belt 61 may be referred to as a transfer position, and a position where transfer may not be performed by separating the first transfer roller 66K or the second transfer roller 66Y, 66M or 66C from the photoconductor 40Y, 40M, 40C or 40K and the transfer belt 61 will be referred as a ready position. The transfer position and the ready position are referred to for convenience of description of an embodiment of the present invention, and do not limit the spirit of the present invention.

As illustrated in FIG. 8, in the ready mode in which printing is not performed, the first slider member 110 and the second slider member 120 remain at a ready position. Thereby, the first transfer roller 66K and the second transfer rollers 66Y, 66M and 66C are separated from the photoconductors 40Y, 40M, 40C and 40K.

As illustrated in FIG. 9, if the ready mode is converted into the mono mode, the first cam member 132 and the second cam member 133 are rotated in the counterclockwise direction according to rotation of the cam rotating shaft 131. The cam profile of the first cam member 132 moves the first slider member 110 in the −Y direction. The cam profile of the second cam member 133 does not move the second slider member 120 and maintains the second slider member 120 at the ready position. Thereby, the first transfer roller 66K moves to the transfer position where a black image by the black developer may be transferred, and the second transfer rollers 66Y, 66M and 66C maintain the ready positions. Therefore, only the first transfer roller 66K is pressed to the first photoconductor 40K. Thus, the transfer device 60 may transfer the black image by the black developer, and thus form a monochrome image.

As illustrated in FIG. 10, if the mono mode is converted into the color mode, the first cam member 132 and the second cam member 133 are rotated in the clockwise direction according to rotation of the cam rotating shaft 131. The cam profile of the first cam member 132 further moves the first slider member 110 in the −Y direction The cam profile of the second cam member 133 moves the second slider member 120 in the +Y direction. Thereby, the first transfer roller 66K maintains the transfer position, and the second transfer rollers 66Y, 66M and 66C move to the transfer positions. Therefore, all of the first transfer roller 66K and the second transfer rollers 66Y, 66M and 66C are pressed to the photoconductors 40Y, 40M, 40C and 40K. Thus, the transfer device 60 may transfer black, cyan, magenta and yellow images, and thus form a color image.

If the color mode is converted into the ready mode, the first cam member 132 and the second cam member 133 are rotated in the counterclockwise direction, and, the cam profile of the first cam member 132 moves the first slider member 110 in the +Y direction. The cam profile of the second cam member 133 moves the second slider member 120 in the −Y direction. Thereby, the first transfer roller 66K and the second transfer rollers 66Y, 66M and 66C move from the transfer positions to the ready positions. Therefore, all of the first transfer roller 66K and the second transfer rollers 66Y, 66M and 66C are separated from the photoconductors 40Y, 40M, 40C and 40K. Thus, the transfer device 60 maintains the ready state (with reference to FIG. 8).

In the respective mode conversions, when the first slider member 110 and the second slider member 120 simultaneously move by cam profiles of the first cam member 132 and the second cam member 133, a time when movement of the first slider member 110 is completed and a time when movement of the second slider member 120 is completed are different. For example, completion of movement of the first slider member 110 is carried out earlier than completion of movement of the second slider member 120. Thereby, overlap between driving load generated during rotation of the first cam member 132 and driving load generated during rotation of the second cam member 133 may be prevented, and thus the total driving load may be reduced. Thereby, a motor of a small capacity may be used and thus a set size and costs may be reduced A lifespan of a device to form/release transfer nips may be increased, reliability in joint and abrasion may be improved, and thus the lifespan of the transfer device may be maximized.

For times when movement of the first slider member 110 and when movement of the second slider member 120 are completed to be different when the first slider member 110 and the second slider member 120 simultaneously move, the cam profiles of the first cam member 132 and the second cam member 133, for example, the phase of the top dead center of the cam profile of the first cam member 132 and the phase of the top dead center of the cam profile of the second cam member 133 are different. For example, the top dead center of the cam profile of the first cam member 132 precedes the phase of the top dead center of the cam profile of the second cam member 133, for example, by an angle of 22 degrees. For example, the first cam member 132 and the second cam member 133 may be configured such that the first cam member 132 reaches the top dead center thereof is earlier than the second cam 133 reaches the top dead center thereof when the color mode is converted into the ready mode.

Accurate recognition of a converted mode by improving a sensing method of the rotating position of a cam together with reduction of cam driving load in mode conversion is disclosed.

If the cam driving load is large, the rotating speed of the cam at respective sections during rotation of the cam may not be uniform. If the rotating speed of the cam is not uniform, the rotating speed of an indicating member connected to the same shaft may be continuously changed, and a sensor sensing the indicating member may not correctly recognize the position of the cam.

A method of recognizing each mode may have elapse of a designated time from sensing of signal change through a sensor is confirmed and then a mode is recognized based on such a time.

Therefore, if the rotating speed is not uniform, a deviation of the signal sensed by the sensor is generated and the sensor senses a time differing from the designated time, thus causing a difficulty in recognizing the current mode.

For example, in mode conversion in which load is suddenly reduced, for example, in conversion from the mono mode to the color mode, force separating and supporting respective transfer rollers more than pressing force of the respective transfer rollers using cams and sliders is returned in the opposite direction and the cams are suddenly rotated, and thus a signal time shorter than the designated time is sensed by the sensor and an error in recognition of the current mode due to the sensed signal time is generated.

However, such mode misrecognition may cause a defect in formation of transfer nips between photoconductors and a transfer belt corresponding thereto, thus causing a defective image.

An algorithm in which positions of slits of the indicating member are recognized and a stopped position of the indicating member after a designated time becomes the position of each mode may be used to recognize respective modes. In this case, if speed change is generated due to cam load change or if other mechanical deviations or time deviation due to sensor deviation is generated, accuracy in mode recognition is greatly lowered.

Figure 11:
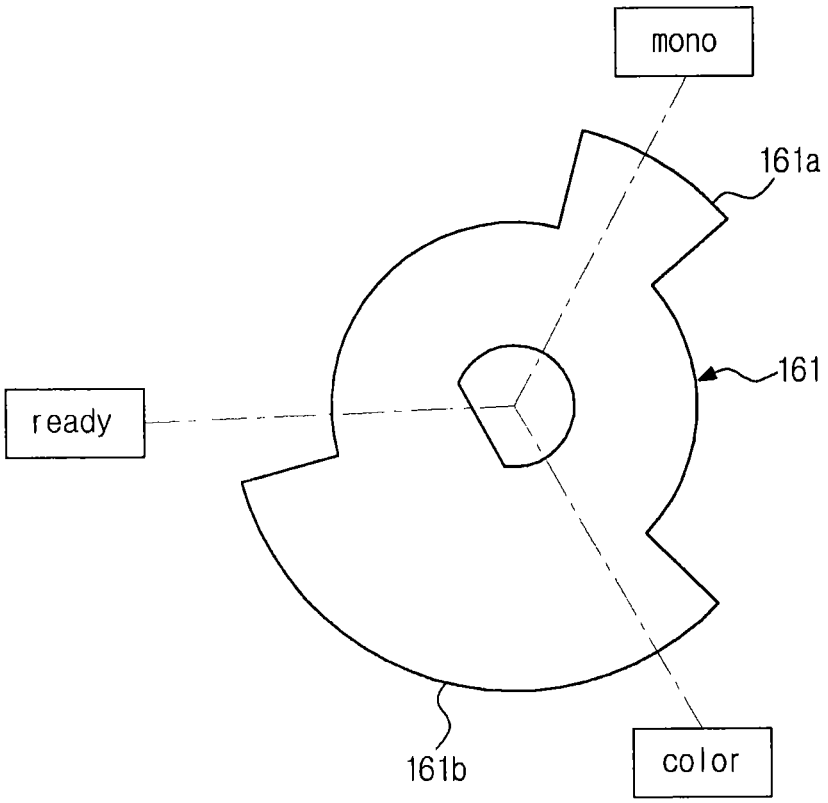
FIG. 11 illustrates an indicating member of the sensing unit of the image forming apparatus in accordance with an embodiment of the present invention.

In accordance with an exemplary embodiment of the present invention, the indicating member and the sensor may be used to recognize the positions of the respective modes, but an algorithm in which the positions of the respective modes are recognized using the number of the indicating parts 161*a* and 161*b* (as illustrated in FIG. 11), not time, is used.

An exemplary method of recognizing the positions of the respective modes is described.

Figure 12:
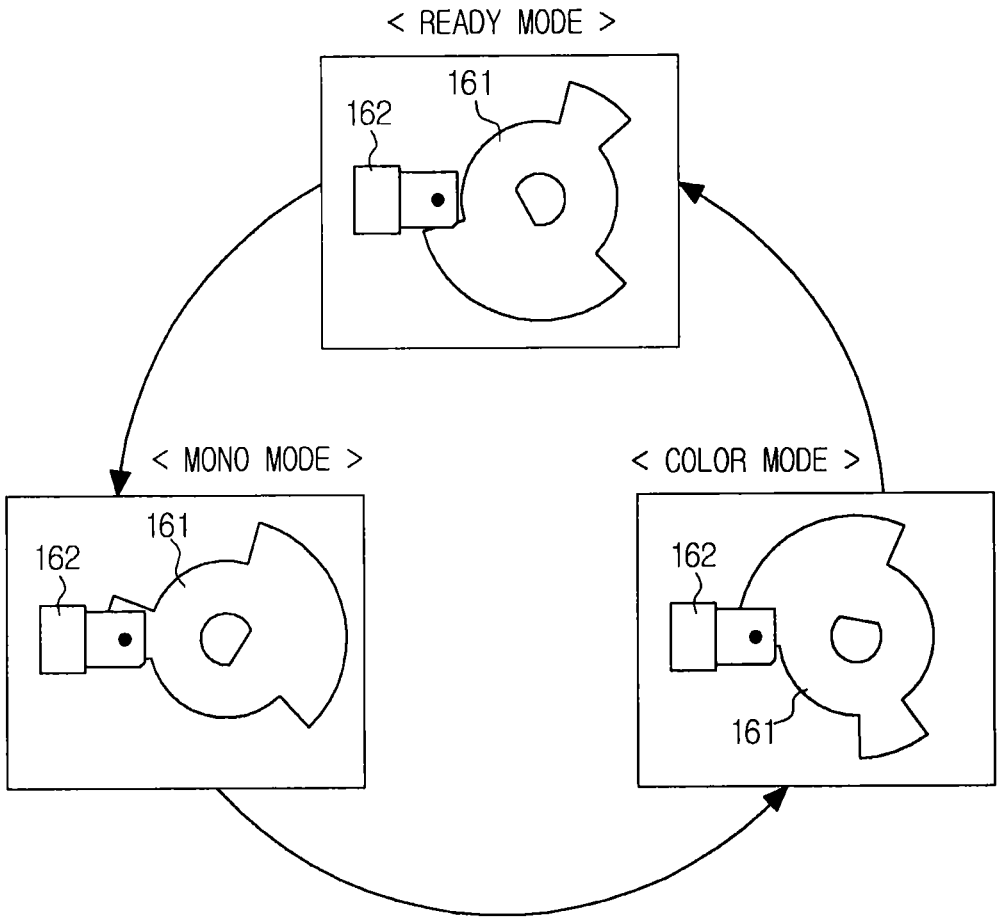
FIG. 12 illustrates exemplary mode positions according to rotating positions of the indicating member of the sensing unit of the image forming apparatus in accordance with an embodiment of the present invention.

FIG. 11 illustrates an indicating member of the sensing unit of the image forming apparatus in accordance with an embodiment of the present invention, and FIG. 12 illustrates mode positions according to rotating positions of the indicating member of the sensing unit of the image forming apparatus in accordance with an embodiment of the present invention.

As illustrated in FIGS. 11 and 12, the indicating member 161 of the sensing unit 160 includes plural indicating parts 161*a* and 161*b* protruding from the circumference of the indicating member 161 to different lengths.

The respective indicating parts 161*a* and 161*b* are separated from each other by a designated interval, and may be disposed on the outer circumferential surface of the indicating member 161 at the designated interval in the circumferential direction.

Respective positions of the indicating member 161 illustrated by a dotted line correspond to the ready mod, the mono mode and the color mode.

The number of the indicating parts of the indicating member 161 may be varied as necessary.

The sensor 162 judges that the current mode is one of the ready mode, the mono mode and the color mode whenever the corresponding position of the indicating member 161 passes through the sensor 162.

The sensor 162 outputs a low signal, i.e., a value "0", before the respective indicating parts 161*a* and 161*b* pass through the sensor 162, and then outputs a high signal, i.e., a value "1", when the respective indicating parts 161*a* and 161*b* pass through the sensor 162.

The sensor 162 may be an optical sensor.

If the mono mode is recognized at the ready mode, the low signal may be continuously recognized for a designated time (an opening signal is recognized), the high signal may be generated and the indicating member 161 may be stopped, thereby causing the image forming apparatus 1 to reach the mono mode.

If the color mode is recognized at the mono mode, the high signal is recognized and the low signal is recognized for a designated time (a closing signal and an opening signal are recognized), the high signal is recognized and then the indicating member 161 is stopped, thereby causing the image forming apparatus 1 to reach the color mode.

If the ready mode is recognized at the color mode, the high signal is recognized for a designated time (a closing signal is recognized), the low signal is recognized and then the indicating member 161 is stopped, thereby causing the image forming apparatus 1 to reach the ready mode. Table 1 illustrates an exemplary number of closing signals and an exemplary number of opening signals in relation to a mode conversion.

TABLE 1

| Mode conversion | Number of closing signals | Number of opening signals |
|---|---|---|
| Ready → Mono | 0 | 1 |
| Mono → Color | 1 | 1 |
| Color → Ready | 1 | 0 |

Figure 13:
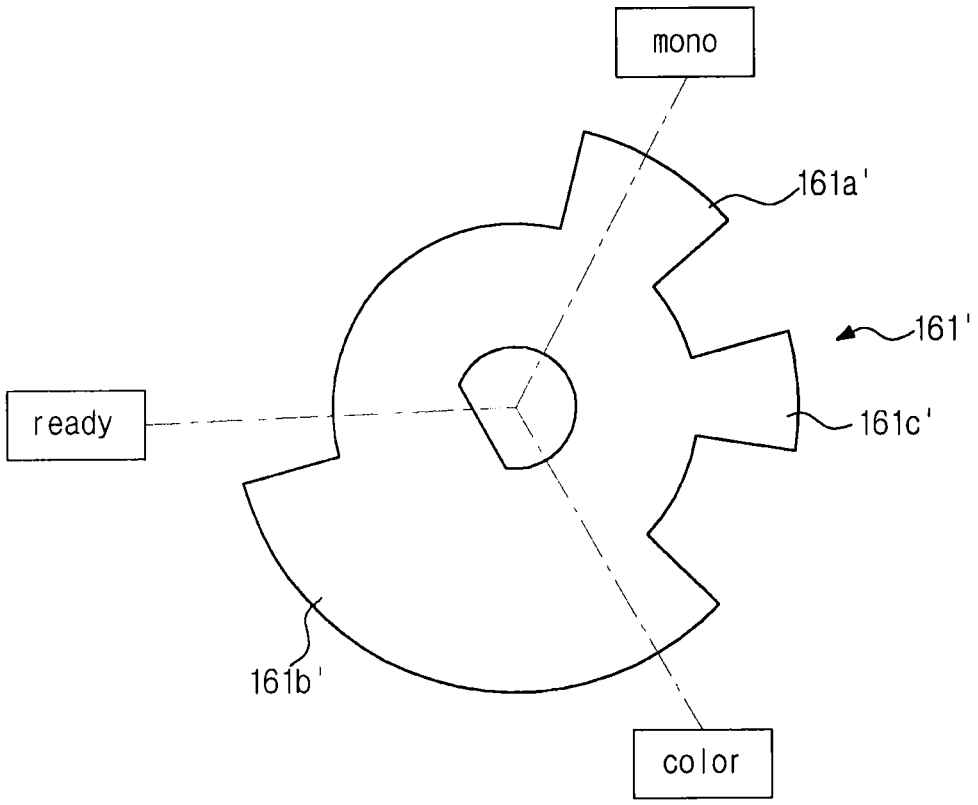
FIG. 13 illustrates an indicating member of the sensing unit of the image forming apparatus in accordance with an embodiment of the present invention.

FIG. 13 illustrates an indicating member of the sensing unit of the image forming apparatus in accordance with an embodiment of the present invention.

As illustrated in FIG. 13, the indicating member 161' includes three indicating parts 161*a*', 161*b*' and 161*c*' protruding from the circumference of the indicating member 161' to different lengths.

The respective indicating parts 161*a*', 161*b*' and 161*c*' are separated from each other by a designated interval, and may be disposed on the outer circumferential surface of the indicating member 161' at the designated interval in the circumferential direction.

Respective positions of the indicating member 161' illustrated by a dotted line correspond to the ready mod, the mono mode and the color mode.

If the mono mode is recognized at the ready mode, the low signal is continuously recognized for a designated time (one low signal is recognized), the high signal is recognized and then the indicating member 161' is stopped, thereby causing the image forming apparatus 1 to reach the mono mode.

If the color mode is recognized at the mono mode, the low signal is recognized twice for a designated time (two low signals are recognized), the high signal is recognized and then the indicating member 161' is stopped, thereby causing the image forming apparatus 1 to reach the color mode.

If the ready mode is recognized at the color mode, the high signal is continuously recognized for a designated time without recognition of the low signal (no low signal is recognized), the low signal is recognized and then the indicating member 161' is stopped, thereby causing the image forming apparatus 1 to reach the ready mode. Table 2 illustrates an exemplary number of closing and opening signals.

TABLE 2

| Mode conversion | Number of closing signals | Number of opening signals |
|---|---|---|
| Ready → Mono | 0 | 1 |
| Mono → Color | 2 | 2 |
| Color → Ready | 1 | 0 |

Figure 14:
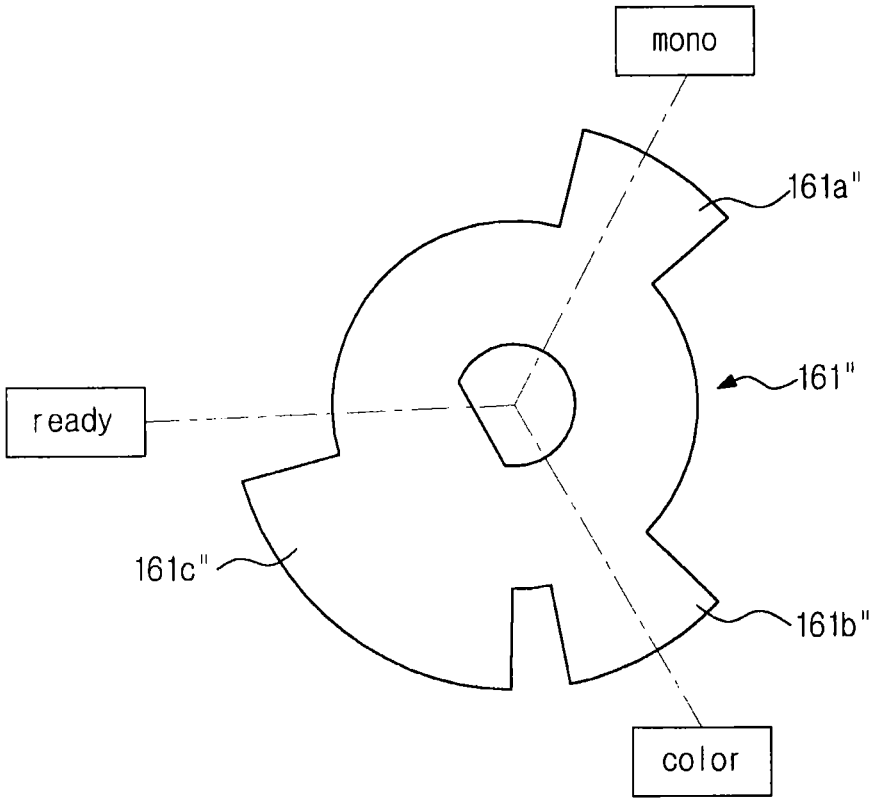
FIG. 14 illustrates an indicating member of the sensing unit of the image forming apparatus in accordance with an embodiment of the present invention.

FIG. 14 illustrates an indicating member of the sensing unit of the image forming apparatus in accordance with the embodiment of the present invention.

As illustrated in FIG. 14, the indicating member 161" includes indicating parts 161*a*", 161*b*" and 161*c*" protruding from the circumference of the indicating member 161" to different lengths.

The respective indicating parts 161*a*", 161*b*" and 161*c*" are separated from each other by a designated interval, and may be disposed on the outer circumferential surface of the indicating member 161" at the designated interval in the circumferential direction.

Here, respective positions of the indicating member 161" illustrated by a dotted line correspond to the ready mod, the mono mode and the color mode.

If the mono mode is recognized at the ready mode, the low signal is continuously recognized for a designated time (one low signal is recognized), the high signal is recognized and then the indicating member 161" is stopped, thereby causing the image forming apparatus 1 to reach the mono mode.

If the color mode is recognized at the mono mode, the high signal is recognized and the low signal is recognized for a designated time (one high signal and one low signal are recognized), the high signal is recognized and then the indicating member 161" is stopped, thereby causing the image forming apparatus 1 to reach the color mode.

If the ready mode is recognized at the color mode, the high signal is recognized, the low signal is recognized and the high signal is recognized for a designated time (two high signals and one low signal are recognized), the low signal is recognized and then the indicating member 161" is stopped, thereby causing the image forming apparatus 1 to reach the ready mode.

TABLE 3

| Mode conversion | Number of closing signals | Number of opening signals |
|---|---|---|
| Ready → Mono | 0 | 1 |
| Mono → Color | 1 | 1 |
| Color → Ready | 2 | 1 |

By mechanically checking the number of indicating parts and stopping cam rotation at a time when a signal of the sensor is converted into another signal not using the algorithm in which a stopped position of the indicating member from a designated position after a designated time becomes the position of each mode, accuracy of the positions of the respective modes are greatly raised. Therefore, the position of the cam may be accurately obtained regardless of speed deviation due to load change, backlash of a driving gear, accumulation tolerance between respective elements and time deviation generated by a sensing error of the sensor.

When cams are rotated during a process of forming/releasing transfer nips between photoconductors and a transfer belt, cam shapes may be simultaneously rotated to simultaneously move two sliders, and thus driving loads generated due to friction between the respective cam shapes and the sliders overlap with each other and the total cam driving load is greatly raised. If the cam driving load is large, the rotating speed at respective sections of the cam is not uniform, and if the rotating speed is not uniform, the rotating speed of an indicating member connected to the same shaft is continuously changed, and a sensor sensing the indicating member may misrecognize the position of the cam. Such mode misrecognition may cause a defect in formation of transfer nips between the photoconductors and the transfer belt corresponding thereto, thus causing a defective image.

The image forming apparatus in accordance with an embodiment of the present invention causes the top dead centers of two cam members, i.e., positions of the two cam members contacting sliders to maximally move the sliders, to be different, and prevents driving loads respectively generated due to rotation of the two cam members from overlapping with each other, thereby reducing the total cam driving load.

The image forming apparatus in accordance with an embodiment of the present invention not only reduces the driving load generated when the cams are rotated but also improves accuracy of the algorithm controlling formation/release of the transfer nips between the photoconductors and the transfer belt, thereby obtaining stable transfer nips between the photoconductors and the transfer belt.

If speed change is generated due to cam load change or if other mechanical deviations or time deviation by the sensor is generated, accuracy in mode recognition is greatly lowered. In case of an embodiment of the present invention, the indicating member and the sensor may be used also to recognize the positions of the respective modes, but the positions of the respective modes are recognized using the number of the indicating parts, not time. Therefore, even if time deviation of the sensor is generated, the positions of the respective modes may be accurately implemented, and thus stable transfer nips between the photoconductors and the transfer belt may be obtained.

Therefore, the image forming apparatus in accordance with an embodiment of the present invention may reduce set costs and size through simple change of cam profiles and change of an algorithm for mode position recognition without a separate additional device, secure reliability of elements, more accurately confirm positions where mode conversion is carried out, and improve an image quality while maintaining stable transfer nips between the photoconductors and the transfer belt.

In a transfer device in accordance with an exemplary embodiment of the present invention, the top dead centers of, for example, two cams, i.e., the positions of the two cams which contact sliders to maximally move the sliders, are different, and driving loads generated due to rotation of the two cams are separated from each other, thus reducing the total cam driving load.

In addition to reduction of the cam driving load, the rotating positions of the cams are accurately sensed by recognizing positions of respective modes using the number of indicating parts of an indicating member having a plurality of slits and rotating together with rotation of the cams, and thus the positions of the respective modes may be accurately sensed. Thereby, transfer nips between photoconductors and a transfer belt may be stably obtained.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a plurality of photoconductors;

a transfer belt to which images formed on the plurality of photoconductors are transferred;

a plurality of transfer rollers corresponding to the plurality of photoconductors, and being movable between transfer positions where the images are transferred to the transfer belt and ready positions separated from the transfer positions;

first slider members moving one of the plurality of transfer rollers between the transfer position and the ready position;

second slider members moving the remaining transfer rollers between the transfer positions and the ready positions; and a driving unit moving the first slider members and the second slider members, wherein:

the driving unit includes first cam members moving the first slider members and second cam members moving the second slider members; and when the plurality of transfer rollers moves from the transfer positions to the ready positions, a time when movement of the first slider members is completed and a time when movement of the second slider members is completed are different in accordance the first cam members and the second cam members, wherein:

the first cam members and the second cam members are connected to a cam rotating shaft passing through both the first slider members and the second slider members;

the first cam member includes a first cam profile pressing a pressed part of the first slider member according to a rotating angle of the first cam member, and the second cam member includes a second cam profile pressing a pressed part of the second slider member according to a rotating angle of the second cam member; and a phase of the top dead center of the first cam profile and a phase of the top dead center of the second cam profile are different so that the time when movement of the first slider members is completed and the time when movement of the second slider members is completed are different.

2. The image forming apparatus according to claim 1, wherein, in order to separate driving load generated due to rotation of the first cam members and driving load generated due to rotation of the second cam members, the first cam profile of the first cam member and the second cam profile of the second cam member are configured such that a position of the first cam profile contacting the pressed part of the first slider member to maximally move the first slider member and a position of the second cam profile contacting the pressed part of the second slider member to maximally move the second slider member are different.

3. An image forming apparatus comprising:

a plurality of photoconductors;

a transfer belt to which images formed on the plurality of photoconductors are transferred;

a plurality of transfer rollers corresponding to the plurality of photoconductors, and being movable between transfer positions where the images are transferred to the transfer belt and ready positions separated from the transfer positions;

first slider members moving one of the plurality of transfer rollers between the transfer position and the ready position;

second slider members moving the remaining transfer rollers between the transfer positions and the ready positions;

a driving unit moving the first slider members and the second slider members;

a motor rotating a cam rotating shaft to which the first cam members and the second cam members are connected;

a sensing unit connected to the cam rotating shaft rotating the first cam members and the second cam members, and including an indicating member with a plurality of indicating parts; and a controller recognizing the rotating position of the indicating member based on change of a signal generated when the plurality of indicating parts of the indicating member passes through the sensing unit, wherein:

the driving unit includes first cam members moving the first slider members and second cam members moving the second slider members; and when the plurality of transfer rollers moves from the transfer positions to the ready positions, a time when movement of the first slider members is completed and a time when movement of the second slider members is completed are different in accordance the first cam members and the second cam members.

4. The image forming apparatus according to claim 3, wherein the controller during recognition of the rotating position of the indicating member recognizes the rotating position of the indicating member as one of a first position corresponding to a first mode in which all of the plurality of transfer rollers are located at the ready positions, a second position corresponding to a second mode in which only transfer roller moved by the first slider members is located at the transfer position, and a third position corresponding to a third mode in which all of the plurality of transfer rollers are located at the transfer positions.

5. The image forming apparatus according to claim 4, wherein the controller during mode conversion moves the indicating member from the first position to the second position, from the second position to the third position, or from the third position to the first position.

6. The image forming apparatus according to claim 5, wherein the controller during mode conversion stops the motor after a designated time from change of the signal generated from the sensing unit when the position of the indicating member corresponding to a mode to be converted is close to the sensing unit.

7. A transfer device of an image forming apparatus comprising:

a transfer belt to which images formed on a plurality of photoconductors are transferred;

a plurality of transfer rollers corresponding to the plurality of photoconductors, and being movable between transfer positions where the images are transferred to the transfer belt and ready positions separated from the transfer positions;

first members moving one of the plurality of transfer rollers between the transfer position and the ready position;

second slider members moving the remaining transfer rollers between the transfer positions and the ready positions; and a driving unit moving the first slider members and the second slider members, wherein:

the driving unit includes first cam members moving the first slider members and second cam members moving the second slider members; and when the plurality of transfer rollers moves from the transfer positions to the ready positions, a time when movement of the first slider members is completed and a time when movement of the second slider members is completed are different in accordance with the first cam members and the second cam members, wherein:

the first cam members and the second cam members are connected to a cam rotating shaft passing through both the first slider members and the second slider members;

the first cam member includes a first cam profile pressing a pressed part of the first slider member according to a rotating angle of the first cam member, and the second cam member includes a second cam profile pressing a pressed part of the second slider member according to a rotating angle of the second cam member; and a phase of the top dead center of the first cam profile and a phase of the top dead center of the second cam profile are different so that the time when movement of the first slider members is completed and the time when movement of the second slider members is completed are different.

8. The transfer device according to claim 7, wherein, in order to separate driving load generated due to rotation of the first cam members and driving load generated due to rotation of the second cam members, the first cam profile of the first cam member and the second cam profile of the second cam member are configured such that a position of the first cam profile contacting the pressed part of the first slider member to maximally move the first slider member and a position of the second cam profile contacting the pressed part of the second slider member to maximally move the second slider member are different.

9. An image forming apparatus comprising:

a plurality of photoconductors;

a transfer belt to which images formed on the plurality of photoconductors are transferred;

a plurality of transfer rollers corresponding to the plurality of photoconductors, and being movable between respective transfer positions where the images are transferred to the transfer belt and respective ready positions separated from the transfer positions;

first slider members moving one of the plurality of transfer rollers between the transfer position and the respective ready position;

second slider members moving the remaining transfer rollers between the respective transfer positions and the respective ready positions; and a driving unit moving the first slider members and the second slider members, wherein:

the driving unit includes first cam members moving the first slider members and second cam members moving the second slider members; and when the plurality of transfer rollers moves from the respective transfer positions to the respective ready positions, the first slider members and the second slider members move simultaneously during a first time, and only one of either the first slider members and the second slider members move during a second time after the first time in accordance the first cam members and the second cam members.

10. An image forming apparatus comprising:

a plurality of photoconductors;

a transfer belt to which images formed on the plurality of photoconductors are transferred;

a plurality of transfer rollers corresponding to the plurality of photoconductors, and being movable between transfer positions where the images are transferred to the transfer belt and ready positions separated from the transfer positions;

first slider members moving one of the plurality of transfer rollers between the transfer position and the ready position;

second slider members moving the remaining transfer rollers between the transfer positions and the ready positions; and a driving unit moving the first slider members and the second slider members, wherein:

the driving unit includes first cam members moving the first slider members and second cam members moving the second slider members; and when the plurality of transfer rollers moves from the transfer positions to the ready positions, a time when movement of the first slider members is completed and a time when movement of the second slider members is completed are different in accordance the first cam members and the second cam members, and wherein the time when movement of the first slider members is completed is earlier than the time when movement of the second slider members is completed.

11. A transfer device of an image forming apparatus comprising:

a transfer belt to which images formed on a plurality of photoconductors are transferred;

a plurality of transfer rollers corresponding to the plurality of photoconductors, and being movable between respective transfer positions where the images are transferred to the transfer belt and respective ready positions separated from the respective transfer positions;

first slider members moving one of the plurality of transfer rollers between the transfer position and the ready position;

second slider members moving the remaining transfer rollers between the respective transfer positions and the respective ready positions; and a driving unit moving the first slider members and the second slider members, wherein:

the driving unit includes first cam members moving the first slider members and second cam members moving the second slider members; and when the plurality of transfer rollers move from the respective transfer positions to the respective ready positions, the first slider members and the second slider members move simultaneously during a first time and only one of either the first slider members and the second slider members move during a second time after the first time in accordance with the first cam members and the second cam members.

12. A transfer device comprising:

a transfer belt to which images formed on a plurality of photoconductors are transferred;

a plurality of transfer rollers corresponding to the plurality of photoconductors, and being movable between transfer positions where the images are transferred to the transfer belt and ready positions separated from the transfer positions;

first slider members moving one of the plurality of transfer rollers between the transfer position and the ready position;

second slider members moving the remaining transfer rollers between the transfer positions and the ready positions; and a driving unit moving the first slider members and the second slider members, wherein:

the driving unit includes first cam members moving the first slider members and second cam members moving the second slider members; and when the plurality of transfer rollers moves from the transfer positions to the ready positions, a time when movement of the first slider members is completed and a time when movement of the second slider members is completed are different in accordance with the first cam members and the second cam members, wherein the time when movement of the first slider members is completed is earlier than the time when movement of the second slider members is completed.

13. A method of transfer in an image forming apparatus comprising:

moving one of a plurality of transfer rollers between a transfer position and a ready position;

moving other of the plurality of transfer rollers between respective transfer positions and respective ready positions; and moving first slider members and second slider members, wherein when the plurality of transfer rollers moves from the respective transfer positions to the respective ready positions, the first slider members and the second slider members move simultaneously during a first time and only one of either the first slider members and the second slider members move during a second time after the first time.

* * * * *

UNITED STATES PATENT AND TRADEMARK OFFICE

CERTIFICATE OF CORRECTION

PATENT NO. : 8,948,654 B2
APPLICATION NO. : 13/681907
DATED : February 3, 2015
INVENTOR(S) : Jeong Yong Ju et al.

It is certified that error appears in the above-identified patent and that said Letters Patent is hereby corrected as shown below:

In the Claims

Claim 7, column 18, line 19, after "first" insert -- slider --.

Signed and Sealed this
Thirtieth Day of June, 2015

Michelle K. Lee

Michelle K. Lee
*Director of the United States Patent and Trademark Office*